US011510468B1

(12) United States Patent
Hwang

(10) Patent No.: US 11,510,468 B1
(45) Date of Patent: Nov. 29, 2022

(54) PHONE STRAP FOR REDUCING DISPOSABLE VINYL

(71) Applicant: Ji Sun Hwang, Seoul (KR)

(72) Inventor: Ji Sun Hwang, Seoul (KR)

( * ) Notice: Subject to any disclaimer, the term of this patent is extended or adjusted under 35 U.S.C. 154(b) by 0 days.

(21) Appl. No.: 17/692,403

(22) Filed: Mar. 11, 2022

(51) Int. Cl.
*A45F 5/10* (2006.01)
*A45C 13/30* (2006.01)

(52) U.S. Cl.
CPC ..... *A45C 13/30* (2013.01)

(58) Field of Classification Search
CPC ... A45C 7/0077; A45C 2200/15; A45C 13/30; A45F 5/10; A45F 2200/0516; H04B 1/3888; B65D 23/104
See application file for complete search history.

(56) References Cited

U.S. PATENT DOCUMENTS 4,685,599 A * 8/1987 Israel ..... G04B 37/1433 968/351
4,897,826 A * 1/1990 Rigberg ..... A44C 5/0053 D10/34
7,063,045 B2 * 6/2006 Van Meter ..... A01K 27/006 150/900
9,277,804 B1 * 3/2016 Gennodie ..... A45C 1/02
9,362,968 B1 * 6/2016 Haymond ..... H04M 1/0281
10,244,837 B2 * 4/2019 Butler ..... A45F 5/00
2009/0020579 A1 * 1/2009 Jackson ..... A45C 13/10 383/2
2011/0279959 A1 * 11/2011 Lopez ..... A45F 5/00 361/679.03
2012/0025684 A1 * 2/2012 Trotsky ..... F16M 11/2028 248/688
2013/0093304 A1 * 4/2013 Childs ..... F16M 11/38 312/240

FOREIGN PATENT DOCUMENTS

KR 20041010 Y1 3/2006
KR 102022340 B1 9/2019
KR 20190105901 A 9/2019
KR 102154759 B1 9/2020

* cited by examiner

*Primary Examiner* — Adam J Waggenspack
(74) *Attorney, Agent, or Firm* — Egbert, McDaniel & Swartz, PLLC

(57) ABSTRACT

A mobile phone strap for reducing disposable vinyl includes a strap and a portable bag. The strap includes a mobile phone fastening part, a strap opening/closing part, a strap interior, and upper and lower straps. The mobile phone fastening part is fastened to a back surface of a mobile phone to fix the strap. The strap opening/closing part includes at one side an opening/closing lower part through which the upper strap and the lower strap is opened and closed. The upper strap and the lower strap of the strap are coupled to form a space in the strap interior. The portable bag is disposed inside the strap interior. The portable bag can be taken out to be used for storing items, so that the consumption of disposable plastic bags can be reduced by replacing the disposable plastic bags with the portable bag.

1 Claim, 9 Drawing Sheets

PHONE STRAP FOR REDUCING DISPOSABLE VINYL

CROSS-REFERENCE TO RELATED APPLICATIONS

Not applicable.

BACKGROUND OF THE DISCLOSURE

Field of the disclosure

The present disclosure relates to a mobile phone strap which promotes the use of portable bags to reduce disposable vinyl widely used in modern daily life. The mobile phone strap of the present disclosure is to reduce the use of disposable vinyl through the portable bag inside the strap of a mobile phone used by the majority of modern people.

Related Art

In the past, paper bags were used to buy and carry food or small items, but the use of disposable plastic bags has rapidly increased for reasons of convenience and the like.

Disposable plastic bags have the advantage of being easy to carry. However recently, as issues such as reduction of environmental pollution and carbon emissions have emerged, use of eco-bags or shopping carts, use of tumblers instead of disposable cups, paper cups and paper wrappers instead of plastic cups or plastic wrappers, and use of paper containers instead of disposable plastic containers are gradually increased.

Despite the growing global awareness to avoid the use of vinyl or plastic, it may take a considerable amount of time to stop using vinyl or plastic or completely replace vinyl or plastic with paper or the like because of its convenience. Therefore, it is required to significantly reduce the use of vinyl or plastic by policy.

In order to reduce the use of a plastic bag that is widely used, such as a cup or container made of vinyl or plastic, the present disclosure makes it convenient to use a portable bag instead of the plastic bag, which increases usability of the portable bag instead of a disposable plastic.

In other words, even if there is a consciousness to reduce the use of disposable plastic bags among people living in various forms of social life, it is not easy to force people to carry eco-bags or eco-friendly shopping baskets, and it is not easy to always carry paper bags or the like.

Even if people try to use a portable bag made of fiber or paper instead of a disposable plastic bag, it is not easy practically. Therefore, in order to reduce the use of disposable plastic bags, it is necessary not only to increase social awareness to suppress the use of disposable plastic bags but also to actively develop various alternative devices.

Meanwhile, in recent years, regardless of gender and age, most people possess a mobile phone. Although the functions and shapes of mobile phones are variously modified or developed, a handle of the mobile phone has been introduced to prevent the mobile phone from being dropped while carrying or using the mobile phone. In addition, the mobile phone handle is recently introduced as an accessory that gives aesthetics to the mobile phone as well as stability and convenience. The present disclosure improves practical and environmental aspects by adding environmental practicality to a mobile phone strap that functions as a mobile phone handle.

In order to avoid the use of the disposable plastic bags, it is needed to carry a portable bag at all times. Therefore, there is an awareness of reducing the use of disposable plastic, but it is difficult to put into practice.

Accordingly, the present disclosure is intended to be helpful in terms of practical and environmental protection by accommodating a portable bag in a mobile phone handle (strap) to reduce the inconvenience caused by carrying the portable bag so that the portable bag can be carried at all times.

As related arts that utilize storage space of a member, Korean Utility Model Registration No. 20-0410104 entitled "Portable storage container hanging on a hook" (Patent Document 1) discloses a storage container for carrying cosmetics and the like in which a body and a lid are connected to each other by a connecting band and the connecting band is made of a soft material with excellent flexibility and used as a hook. For example, the portable storage container may be used as a decoration by being hanged on, e.g., a strap hook of a mobile phone so that the contents are easy to use and there is no fear of dropping or loss. However, Patent Document 1 has the difference from the present disclosure in that a separate component is added to configure the accommodation space, but in the present disclosure, a handle part is made of a flexible material and the interior of the handle part is used as a storage space.

Korean Patent Laid-open Publication No. 10-2019-0105901 entitled "Strap for bag with improved storage of items" (Patent Document 2) discloses a strap for bag with improved storage capability that can store items in the bag, wherein the strap for bag comprises: a first strap part formed along a longitudinal direction of one surface; a hook member provided at one end of the first strap part and installed to be connected to a hook ring inside the bag; and an item fastening part having at least one item fastening region formed along a longitudinal direction of a body of the first strap part as a portion for hanging the hook member and a connecting member connected to the item. However, the difference between Patent Document 2 and the present disclosure is that the present disclosure can store items by placing them directly on a strap.

Korean Patent No. 10-2154759 entitled "Umbrella with a storage handle" (Patent Document 3) discloses an umbrella having a storage handle detachable at a bottom of an umbrella stand which is also used as an umbrella case to store the umbrella therein, wherein the storage handle provides ventilation and easy removal of rainwater remaining in the umbrella. Patent Document 3 is different from the present disclosure in that the former is to accommodate the umbrella in the storage of the handle of the umbrella, and the latter is to accommodate separate portable bags in a strap as an accessory or handle for supporting a mobile phone.

Korean Patent No. 10-2022340 entitled "Card case for attachment to a mobile phone" (Patent Document 4) discloses a wallet-type case attached to a mobile phone, which allows the mobile phone be stably carried using a locking means formed to open and close the case at one side of the case, wherein a case body including a card insertion slot is coupled to aback surface 1 of the mobile phone to provide a card case. In Patent Document 4 and the present disclosure, it is similar to serve as a handle of a mobile phone while accommodating an item to be stored, but the case of Patent Document 4 and the strap of the present disclosure are different in that the detailed items stored therein are different, and there is a difference in vibration when they are used as a holder.

(Prior Art Document)

(Patent Document)

1. Korean Utility Model Registration No. 20-0410104 (2006 Feb. 23)
2. Korean Patent Laid-open Publication No. 10-2019-0105901 (2019 Sep. 18)
3. Korean Patent No. 10-2154759 (2020 Sep.4)
4. Korean Patent No. 10-2022340 (2019 Sep. 10)

BRIEF SUMMARY OF THE INVENTION

The present disclosure is conceived to solve the above problems, and provides a strap as a mobile phone handle.

In addition, the present disclosure is to increase the use of portable bags and the like, instead of the use of disposable plastic bags. In order to eliminate the inconvenience of always carrying a portable bag as a replacement for the widely used disposable plastic bag, the present disclosure arranges a portable bag in a strap as a mobile phone handle, and the strap functions as the handle normally and when carrying small items, the portable bag can be used instead of a disposable plastic bag.

Therefore, the present disclosure provides advantageous effects in terms of practical and environmental protection by reducing the inconvenience caused by carrying a portable bag by accommodating a portable bag inside the handle (strap) of the mobile phone to allow the portable bag to be carried at all times.

In addition, the strap as a mobile phone handle can absorb vibrations of the mobile phone placed on a desk or the like during work or class, thereby eliminating discomfort to other people.

In addition, the strap as a mobile phone handle can serve as a holder when watching a video using a mobile phone.

In accordance with an aspect of the present disclosure, there is provided a strap (100) for a mobile phone, which is configured to accommodate a portable bag (300).

The strap (100) comprises: a mobile phone fastening part (110), a strap opening/closing part (120), and a strap interior (130); and an upper strap (101) and a lower strap (102).

The mobile phone fastening part (110) is fastened to a back surface (1) of a mobile phone to fix the strap (100).

The strap opening/closing part (120) includes at one side an opening/closing lower part (122) through which the upper strap (101) and the lower strap (102) is opened and closed.

The upper strap (101) and the lower strap (102) of the strap (100) are coupled to form a space in the strap interior (130), and the portable bag (300) is disposed inside the strap interior (130).

In a state that the opening/closing lower part (122) of the strap opening/closing part (120) is closed, the portable bag (300) is disposed in the space of the strap interior (130) and the strap (100) is used as a mobile phone handle.

The portable bag (300) in the strap interior (130) is independently taken out to be used in a state that the opening/closing lower part (122) of the strap opening/closing part (120) is opened.

Meanwhile, the strap opening/closing part (120) may include at both sides an opening/closing upper part (121) and the opening/closing lower part (122) through which the upper strap (101) and the lower strap (102) are opened and closed.

A bag coupling part (131) may be provided at a lower portion in the strap interior (130) of the upper strap (101) and the lower strap (102).

The portable bag (300) may include an inner coupling part (310) and a bag handle (320).

The bag coupling part (131) of the strap interior (130) and the inner coupling part (310) of the portable bag (300) maybe coupled to each other.

In a state that the opening/closing upper part (121) and the opening/closing lower part (122) of the strap opening/closing part (120) are closed, the portable bag (300) is disposed in the space of the strap interior (130) and the strap (100) is used as the mobile phone handle.

In a state that the opening/closing upper part (121) and the opening/closing lower part (122) of the strap opening/closing part (120) are opened, the portable bag (300) in the strap interior (130) is taken out to be used while the portable bag (300) is connected to the strap interior (130).

The strap (100) may further comprise a strap folding part (140).

The strap folding part (140) may serve to fold and unfold the strap (100), and the strap (100) may include strap folding fastening parts (141, 142) for fastening when the strap (100) is folded.

The strap (100) may further comprise a character part (200).

The character part (200) may include a strap fastening part (210), a character opening/closing part (220), and a character interior (230).

The character part (200) includes an upper character (201) and a lower character (202).

The strap fastening part (210) fastens the character part (200) to the strap (100).

The character opening/closing part (220) includes at one side an opening/closing lower part (222) through which the upper character (201) and the lower character (202).

The upper character (201) and the lower character (202) of the character part (200) are coupled to form a space in the character interior (230).

The portable bag (300) is disposed in the character interior (230).

The portable bag (300) is disposed in the character interior (230).

In a state that the opening/closing upper part (221) and the opening/closing lower part (222) of the character opening/closing part (220) are closed, the portable bag (300) is disposed in the space of the character interior (230) and the strap (100) is used as a mobile phone handle.

In a state that the opening/closing upper part (221) and the opening/closing lower part (222) of the character opening/closing part (220) are opened, the portable bag (300) in the character interior (230) is taken out to be used while the portable bag (300) is connected to the character interior (230).

The character opening/closing part (220) may include at both sides an opening/closing upper part 221 and the opening/closing lower part (222) through which the upper character (201) and the lower character (202) are opened and closed.

A bag coupling part (231) may be provided at a lower portion in the character interior (230) of the upper character (201) and the lower character (202).

The portable bag (300) may include an inner coupling part (310) and a bag handle (320).

The bag coupling part (231) in the character interior (230) and the inner coupling part (310) of the portable bag (300) may be coupled to each other.

In a state that the opening/closing upper part (221) and the opening/closing lower part (222) of the character opening/closing part (220) are closed, the portable bag (300) is disposed in the space of the character interior (230) and the strap (100) is used as a mobile phone handle.

In a state that the opening/closing upper part (221) and the opening/closing lower part (222) of the character opening/closing part (220) are opened, the portable bag (300) in the character interior (230) is taken out to be used while the portable bag (300) is connected to the character interior (230).

The character part (200) may further include a character folding part (240)

The character folding part (240) serves to fold and unfold the character part (200), and includes character folding fastening parts (241 and 242) for fastening when the character part (200) is folded.

A back surface (150) of the strap (100) may include a support (160).

The support (160) may include a support fixing part (161) and a supporting part (162).

The supporting part (162) has a thin rod shape, and one end of the supporting part (162) is hinge-coupled to the support fixing part (161) through a male and female engagement to be rotatable, and the supporting part (162) is erected to be in contact with the back surface (1) of the mobile phone.

The present disclosure has the effect of providing a strap as a mobile phone handle when gripping a mobile phone in a daily life.

In addition, the portable bag is disposed inside the strap to function as a mobile phone handle in normal use, and is used as a bag to replace the disposable plastic bag when purchasing small items. Accordingly, there is an environmentally beneficial effect of reducing consumption of the disposable plastic bag.

In particular, although there is a perception to reduce the consumption of disposable plastic bags, there is a limit that it is difficult to be practiced due to the inconvenience of carrying a portable bag. The present disclosure can overcome such limitation by allowing a portable bag to be carried naturally.

In addition, the present disclosure has the effect of providing advantageous effects in terms of practical and environmental protection by reducing the inconvenience caused by carrying a portable bag by including a portable bag inside the strap as a mobile phone handle at all times.

In addition, the present disclosure has an effect of absorbing the vibrations when the mobile phone is placed on a desk or the like during work or class, which reduces discomfort to other people.

In addition, the present disclosure has an effect of providing a convenient supporting function when viewing a video using a mobile phone.

DETAILED DESCRIPTION OF THE INVENTION

Figure 1A:
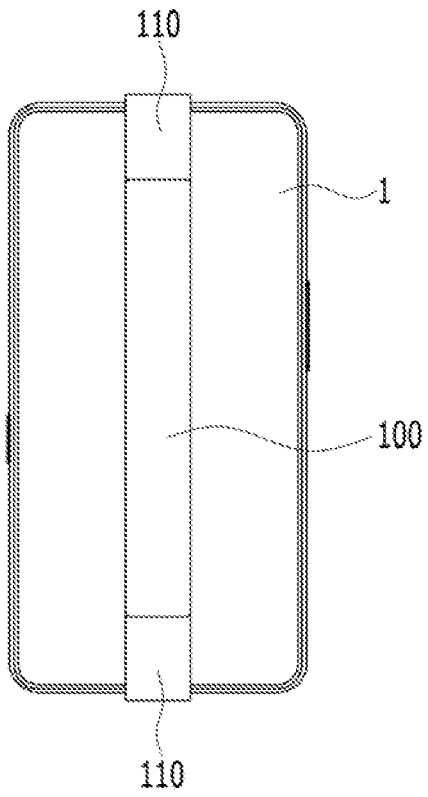
FIGS. 1A and 1B show the overall appearance of a strap according to one embodiment of the present disclosure.

Hereinafter, when it is determined that a detailed description of a related known technology may unnecessarily obscure the subject matter of the present disclosure, the detailed description thereof will be omitted. In addition, the number used in the description of the present specification is only an identification symbol for distinguishing one component from other components.

Accordingly, the configurations shown in the embodiments and drawings described in the present specification are only preferred embodiments of the present disclosure, and do not express all the technical spirit of the present disclosure, so various equivalents and variations that can replace them may exist at the time of the present application.

The preferred embodiment of the present disclosure will be described in more detail, but the already known technical parts will be omitted or compressed for the sake of brevity of description.

One embodiment of the present disclosure may largely include a strap 100, a character part 200, and a portable bag 300.

The strap 100 may include a mobile phone fastening part 110, a strap opening/closing part 120, a strap interior 130, and a strap folding part 140.

The contact area between the strap 100 and a back surface 1 of a mobile phone is defined as a strap back surface 150.

The strap 100 may further include a support 160.

In the present disclosure, the portable bag 300 means a reusable and portable bag, unlike a disposable bag.

Figure 1B:
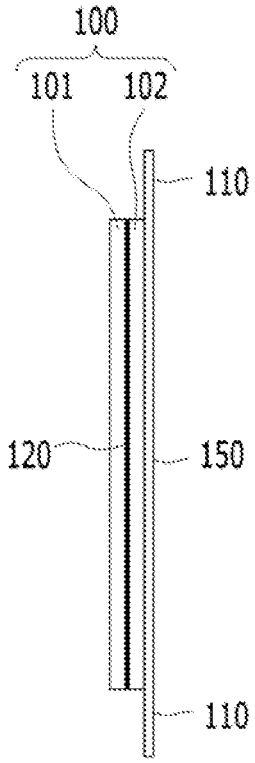

As shown in FIGS. 1A and 1B, in one embodiment of the present disclosure, the strap 100 can be fixed by attaching the mobile phone fastening part 110 provided at upper and lower portions of the strap 100 to upper and lower portions of the back surface 1 of the mobile phone in normal use.

The strap 100 may include an upper strap 101 and a lower strap 102.

Figure 2A:
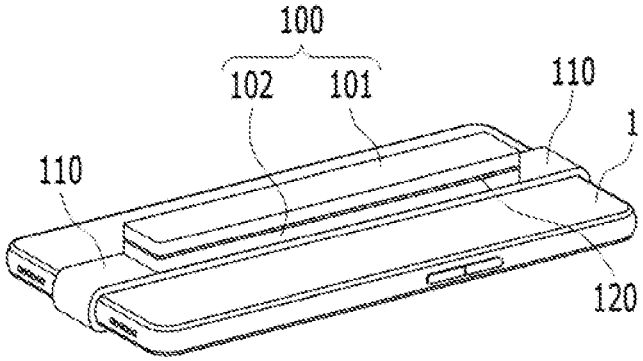
FIGS. 2A and 2B show the opening and closing state of an opening and closing part of the strap according to one embodiment of the present disclosure.
Figure 2B:
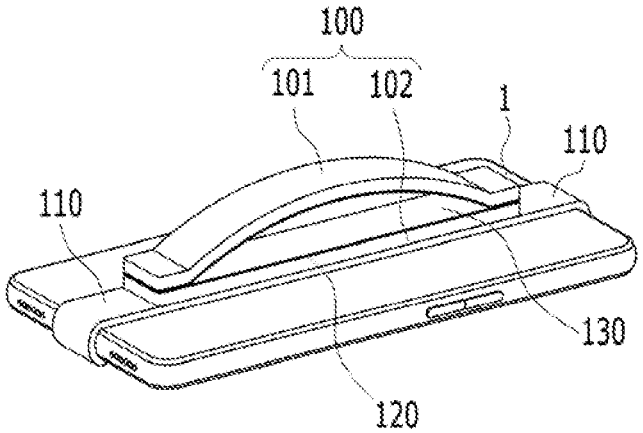

As shown in FIGS. 2A and 2B, the strap 100 according to one embodiment of the present disclosure may form a space between two layers of the upper strap 101 and the lower strap 102 to define a space of the strap interior 130.

The mobile phone fastening part 110 may be connected to the upper and lower portions of the upper strap 101 or the lower strap 102, but it is convenient in use to connect the mobile phone fastening part to the upper and lower portions of the lower strap 102.

The strap 100 according to one embodiment of the present disclosure is made of a fabric material as a mobile phone handle.

The attachment of the mobile phone fastening part 110 to the back surface 1 of the mobile phone may be performed by a known attachment method, and is not particularly limited.

In this case, in normal use, by holding the back surface 1 of the mobile phone with one hand in normal times while putting the palm between the strap 100 and the back surface 1 of the mobile phone, a user can use the strap 100 as a mobile phone handle.

As shown in FIGS. 2A and 2B, the strap opening/closing part 120 may connect the upper strap 101 and the lower strap 102 of the strap 100.

The strap opening/closing part 120 is an opening/closing part having an opening and closing function like a zipper to fasten the upper strap 101 and the lower strap 102 of the strap 100, and in normal use, the strap opening/closing part 120 is fastened in a closed state with the upper strap 101 and the lower strap 102 closed, and the strap 100 can be used as a mobile phone handle.

Figure 3:
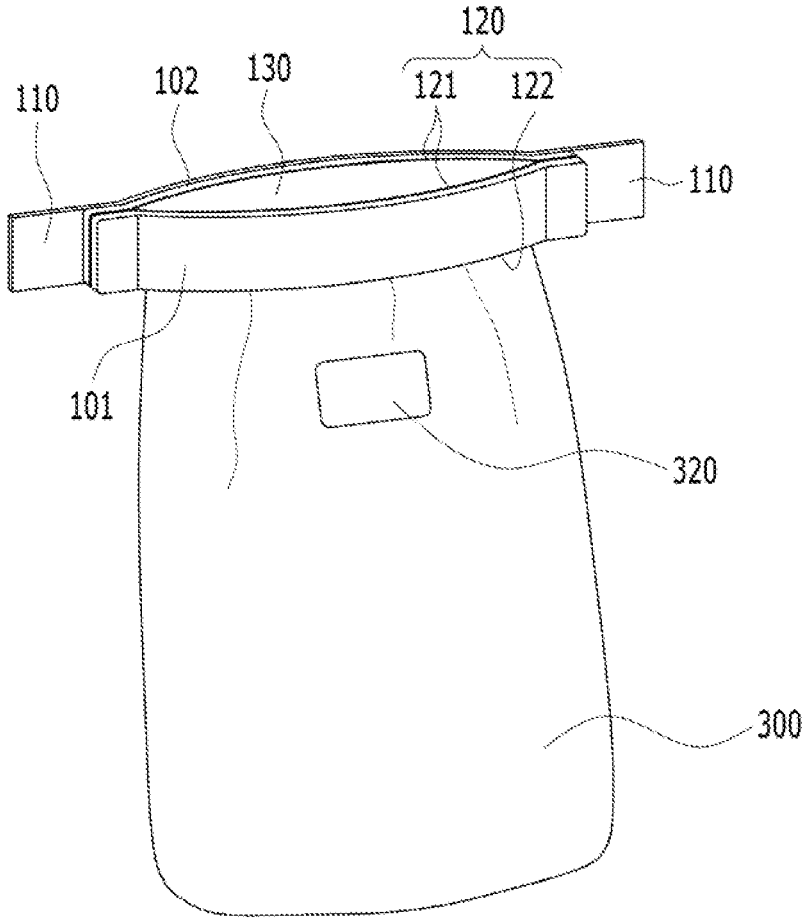
FIG. 3 shows a state that a portable bag is taken out from the inside of the strap according to one embodiment of the present disclosure.

As shown in FIG. 3, the strap opening/closing part 120 may include an opening/closing upper part 121 for opening and closing an upper portion of the strap opening/closing part 120 or an opening/closing lower part 122 for opening/closing a lower portion of the strap opening/closing part 120.

The method of opening and closing the strap opening/closing part 120 is not particularly limited.

Further, the strap opening/closing part 120 may be disposed only at one side of the strap 100.

In this case, the strap opening/closing part 120 may include only the opening/closing lower part 122 disposed at one side of the strap 100.

In addition, the strap opening/closing part 120 may be provided at both sides of the strap 100.

In this case, the strap opening/closing part 120 may include the opening/closing upper part 121 and the opening/closing lower part 122 provided at both sides of the strap 100.

When the strap opening/closing part 120 includes only the opening/closing lower part 122 at one side of the strap 100, in normal use, the portable bag 300 is placed in the space of the strap interior 130 and the opening/closing lower part 122 of the strap opening/closing part 120 is closed. Further, when using the portable bag 300, the user opens the opening/closing lower part 122 of the strap opening/closing part 120 and takes out the portable bag 300 from the strap interior 130 to use the portable bag 300 independently.

Then, when storing the portable bag 300 taken out again after using it for storage and holding of an item, the user can open the opening/closing lower part 122 of the strap opening/closing part 120 and put the portable bag 300 in the strap interior 130, and the user can close the opening/closing lower part 122 to use the strap 100 as a mobile phone handle again.

Meanwhile, as shown in FIG. 3, the strap opening/closing part 120 may include the opening/closing upper part 121 and the opening/closing lower part 122 provided at both sides of the strap 100.

In this case, in normal use, the portable bag 300 is disposed in the space of the strap interior 130 and the opening/closing upper part 121 and the opening/closing lower part 122 of the strap opening/closing part 120 are closed. Further, when using the portable bag 300, the user can open the opening/closing upper part 121 and the opening/closing lower part 122 at both sides of the strap opening/closing part 120 to take out only the portable bag 300 from the strap interior 130, so that the portable bag 300 can be used while being connected to the strap interior 130.

At this time, the opening/closing upper part 121 of the strap opening/closing part 120 functions as a handle that the user can grip by the hand, and the opening/closing lower part 122 functions as a passage for the portable bag 300.

Figure 4:
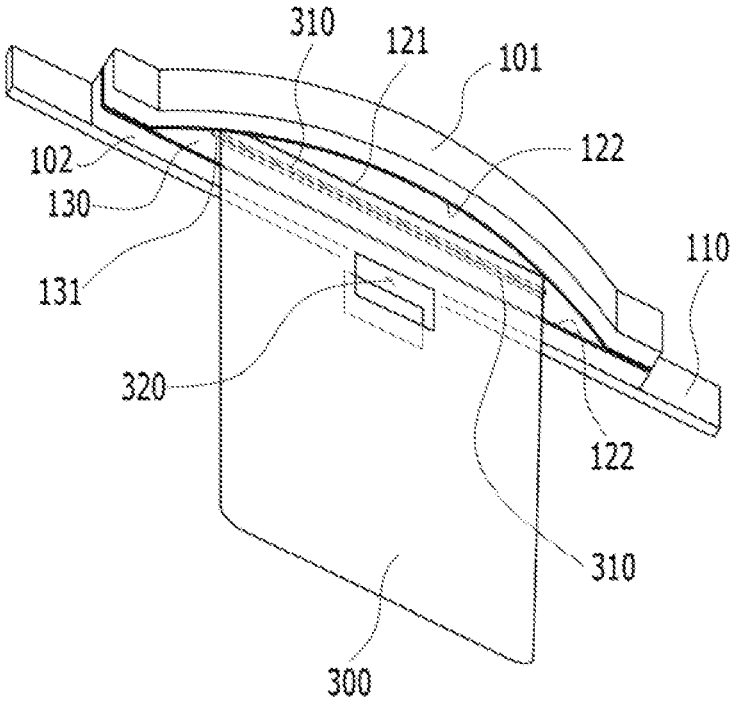
FIG. 4 shows a coupling portion inside the strap to which the portable bag is coupled according to one embodiment of the present disclosure.

As shown in FIG. 4, when the strap opening/closing part 120 includes the opening/closing upper part 121 and the opening/closing lower part 122 at both sides of the strap 100, at an upper side in the strap interior 130, a bag coupling part 131 to which the portable bag 300 is coupled may be provided below the opening/closing upper part 121 of the strap opening/closing part 120.

In this case, each of the upper strap 101 and the lower strap 102 constituting the strap 100 may include the bag coupling part 131 at the upper side in the strap interior 130.

In addition, the portable bag 300 may include an inner coupling part 310 and a bag handle 320.

Further, the portable bag 300 may be made of a fabric material that can be used repeatedly as long as it is not significantly contaminated.

In this case, the bag coupling part 131 below the opening/closing upper part 121 in the strap interior 130 may be coupled to the inner coupling part 310 of the portable bag 300 to fix the portable bag 300.

The sealing coupling part 131 and the inner coupling part 310 are coupled to each other to be fixed, and may be configured as fasteners so that the portable bag 300 can be replaced whenever necessary, such as when the portable bag 300 is significantly contaminated.

The upper strap 101 may be fastened to one side of the portable bag 300, and the lower strap 102 may be fastened to the other side of the portable bag 300.

Specifically, the bag coupling part 131 at the upper side of the strap interior 130 under the opening/closing part 121 of the strap opening/closing part 120 in the upper strap 101 may be coupled to the inner coupling part 310 at an upper end of one side of the portable bag 300, and the bag coupling part 131 at the upper side in the strap interior 130 under the opening/closing part 121 of the strap opening/closing part 120 in the lower strap 102 may be coupled to the inner coupling part 310 at an upper end of the other side of the portable bag 300.

Accordingly, in the state that the opening/closing upper part 121 of the strap opening/closing part 120 is closed, the upper end of the portable bag 300 inserted in the strap interior 130 with the bag coupling part 131 and the inner coupling part 310 coupled to each other. In the state that the opening/closing lower part 122 of the strap opening/closing part 120 is closed after the portable bag 300 is folded or rolled to be put in the strap interior 130 through the opening/closing lower part 122, the strap 100 functions as a handle with the portable bag 300 stored in the strap interior 130.

On the other hand, in the state that the opening/closing upper part 121 of the strap opening/closing part 120 is open, the upper end of the portable bag 300 is inserted in the strap interior 130 and exposed to the outside with the bag coupling part 131 and the inner coupling part 310 coupled to each other. Further, in the state that the opening/closing lower part 122 of the strap opening/closing part 120 is open, the portable bag 300 stored in the strap interior 130 can be taken out through the opening/closing lower part 122 of the strap opening/closing part 120 to be used as the portable bag 300.

That is, the user can grip the mobile phone; the strap 100 and the bag handle 320 of the portable bag 300 with one hand to hold them.

Therefore, although even if there is a desire to carry the portable bag 300 to replace the disposable plastic bag, it is difficult to carry the portable bag 300 actually due to the inconvenience of carrying it, according to one embodiment of the present disclosure, by storing the portable bag 300 in the strap of a mobile phone, it is easier for a user to carry and use the portable bag 300 to replace the disposable plastic bag.

In addition, since the material of the strap 100 and the strap interior 130 is fabric, when the mobile phone is placed on a desk at school or work with the strap 100 contacted with the desk, the strap 100 made of the fabric material can absorb vibrations of the mobile phone, which reduces the discomfort caused to others due to the vibrations of the mobile phone.

Figure 5:
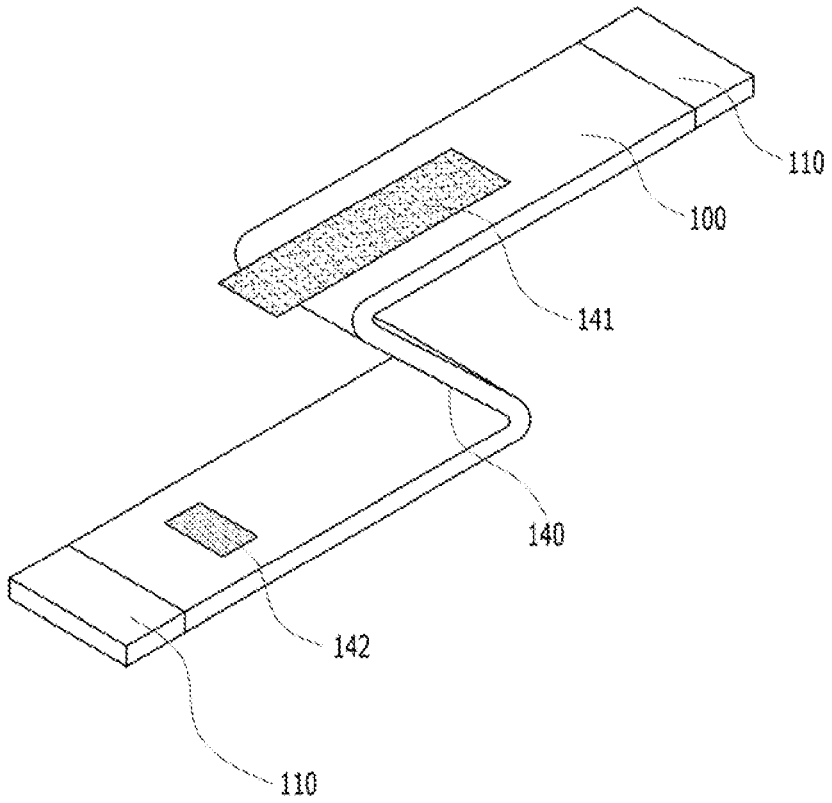
FIG. 5 shows an example of the strap which is adjustable in length according to one embodiment of the present disclosure.

In addition, as shown in FIG. 5, the strap 100 including the upper strap 101 and the lower strap 102 may include a strap folding part 140.

The strap folding part 140 may include strap folding fastening parts 141 and 142 at both sides of the upper strap 101, respectively.

The strap folding part 140 functions to allow the strap 100 to be folded and unfolded. When the strap 100 is used as a mobile phone handle, the strap folding part 140 and the strap 100 are folded. Further, when the strap 100 is used as a portable bag 300, the strap folding part 140 and the strap 100 are unfolded so that the portable bag 300 can be used with the entrance thereof increased.

Therefore, when the strap folding part 140 is folded and the opening/closing upper part 121 of the strap opening/closing part 120 is closed, the portable bag 300 is inserted in the strap interior 130 in the state that the upper end of the portable bag 300 is also folded. The portable bag 300 is folded or rolled into the strap interior 130 through the opening/closing lower part 122 and then the opening/closing lower part 122 of the strap opening/closing part 120 is closed. In this state, the strap 100 functions as a handle for the mobile phone.

On the other hand, in a state in which the strap folding part 140 is unfolded and the opening/closing upper part 121 of the strap opening/closing part 120 is opened, the upper end of the portable bag 300 in the strap interior 130 is exposed to the outside. Further, in a state in which the opening/closing lower part 122 of the strap opening/closing part 120 is open, when the portable bag 300 stored in the strap interior 130 is taken out through the opening/closing lower part 122 of the strap opening/closing part 120, to be used as the portable bag 300, it is possible to use the portable bag 300 with the entrance thereof increased due to the unfolded strap folding part 140.

Figure 6A:
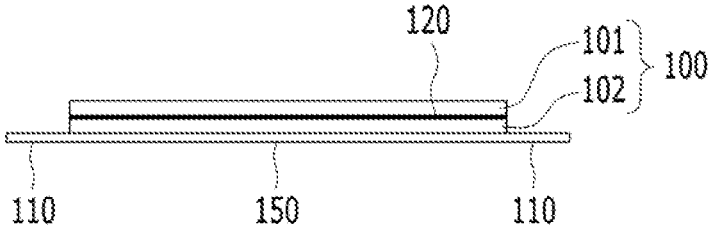
FIGS. 6A and 6B show a mounting portion disposed on a back of the strap according to one embodiment of the present disclosure.
Figure 6B:
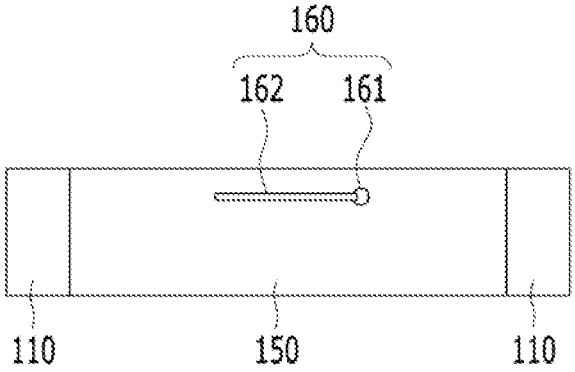

As shown in FIGS. 6A and 6B, the present disclosure may further include a support 160 for supporting a mobile phone.

The support 160 may be included in the strap back surface 150 in which the lower strap 102 of the strap 100 and the back surface 1 of the mobile phone contact.

The support 160 may include a support fixing part 161 and a supporting part 162.

The supporting part 162 has a thin rod shape, and one end of the supporting part 162 is hinge-coupled to the support fixing part 161 through a male and female engagement to be rotatable.

Therefore, in normal use, the supporting part 162 is coupled with the support fixing part 161 and is laid on the strap back surface 150, so that there is no inconvenience when the strap 100 is used as a mobile phone handle or placed on a desk.

Meanwhile, when a user uses the support 160 to view a video or the like, the supporting part 162 is erected to be in contact with the back surface 1 of the mobile phone, so that the strap 100 can be used as the supporting part 162 due to its own elasticity.

Figure 7A:
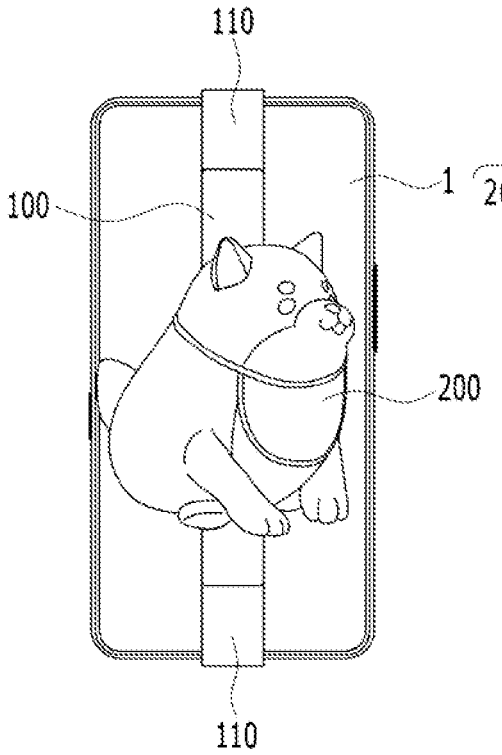
FIGS. 7A and 7B are plan and profile views, respectfully, showing a state in which a character decoration is coupled to the strap according to one embodiment of the present disclosure.
Figure 7B:
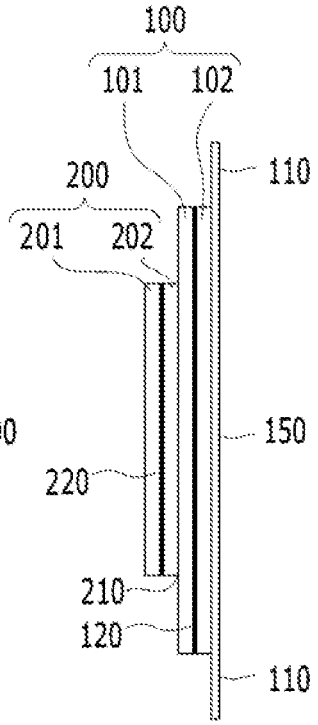

Meanwhile, one embodiment of the present disclosure may further include a character part 200 coupled to the strap 100 as shown in FIG. 7.

As shown in FIG. 7, The character part 200 may include a strap fastening part 210, a character opening/closing part 220, a character interior 230, and a character folding part 240.

The character part 200 may include an upper character 201 and a lower character 202.

The strap fastening part 210 is provided at a back side of the character part 200 to couple the strap 100 and the character part 200.

The fastening method of the strap fastening part 210 may include Velcro, a snap button, and the like without any particular limitation.

In addition, the character part 200 can be used while being coupled to the strap 100 when the strap 100 is used as a mobile phone handle, and when the portable bag 300 is used, the portable bag 300 can be used in a state that the character part 200 is coupled to the strap 100 or separated from the strap 100.

The character opening/closing part 220 may include an opening/closing lower part 222, for opening and closing the upper character 201 and the lower character 202, provided at one side of the upper character 201 and the lower character 202.

Accordingly, the upper character 201 and the lower character 202 of the character part 200 are combined to form a space in the character interior 230, and the portable bag 300 may be disposed in the character interior 230.

When the opening/closing lower part 222 of the character opening/closing part 220 is closed, the portable bag 300 can be disposed in the space of the character interior 230 to be used as a mobile phone handle. Further, the user can open the opening/closing lower part 222 of the character opening/closing part 220 and independently take out the portable bag 300 in the character interior 230 to use it.

When the character part 200 is used as a mobile phone handle, the character part 200 is used in a state that it is fastened to the strap 100, and when the portable bag 300 is taken out from the character part 200 to be used, the character part 200 can be used in a state that it is fastened to or separated from the strap 100.

Figure 8:
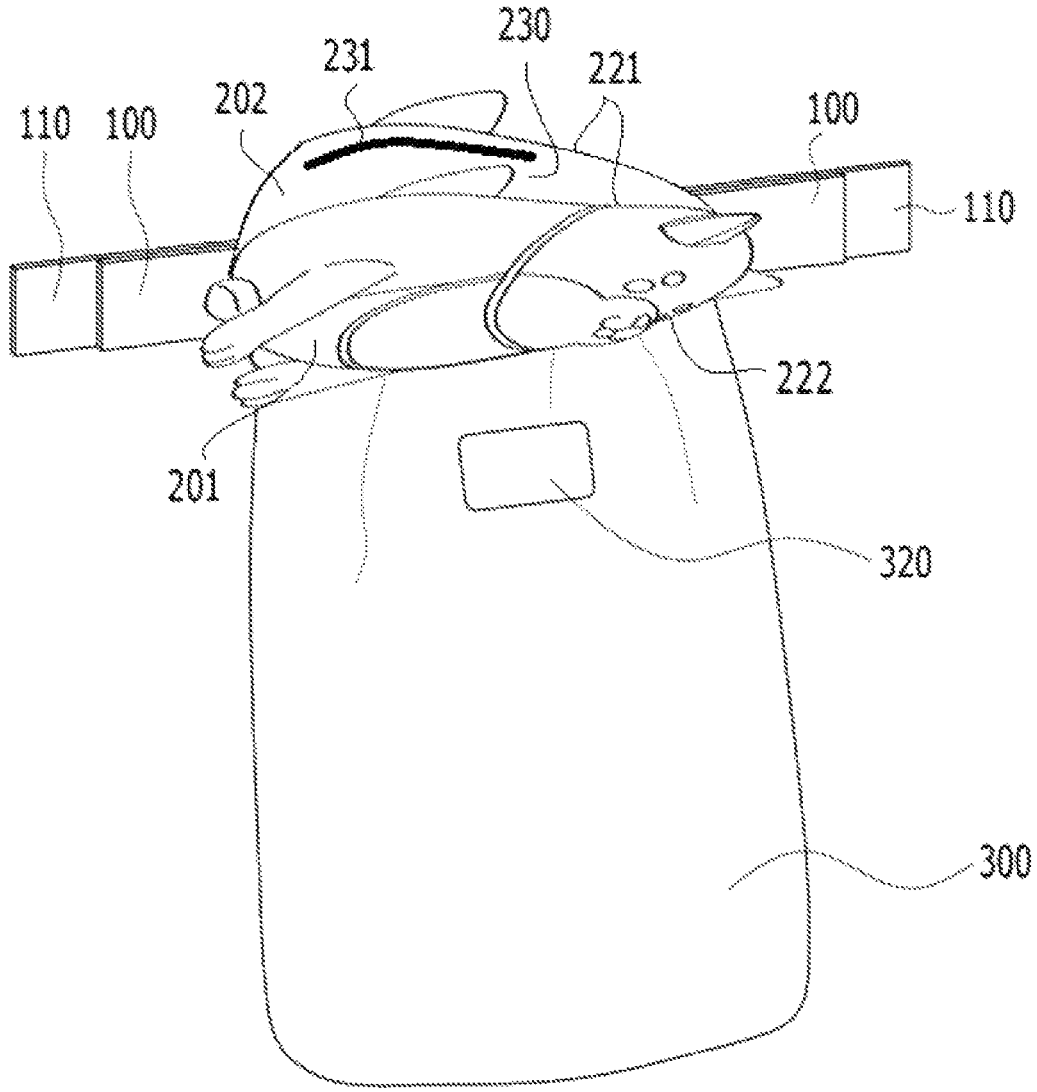
FIG. 8 shows a coupling portion inside the character decoration to which the portable bag is coupled according to one embodiment of the present disclosure.

Meanwhile, as shown in FIG. 8, the character opening/closing part 220 may include an opening/closing upper part 221 and the opening/closing lower part 222 provided at both sides of the upper character 201 and the lower character 202, and may further include a bag coupling portion 231 at an upper side in the character interior 230 of the upper character 201 and the lower character 202.

The portable bag 300 includes an inner coupling part 310 and a bag handle 320.

The bag coupling portion 231 in the character interior 230 and the inner coupling part 310 of the portable bag 300 are fastened to each other.

In a state that the opening/closing upper part 221 and the opening/closing lower part 222 of the character opening/closing part 220 are closed, the portable bag 300 is disposed in the space of the character interior 230, and the strap can be used as a mobile phone handle.

On the other hand, in the state in which the opening/closing upper part 221 and the opening/closing lower part 222 of the character opening/closing part 220 are opened, the portable bag 300 in the character interior 230 can be taken out to be used while being connected to the character interior 230.

Figure 9:
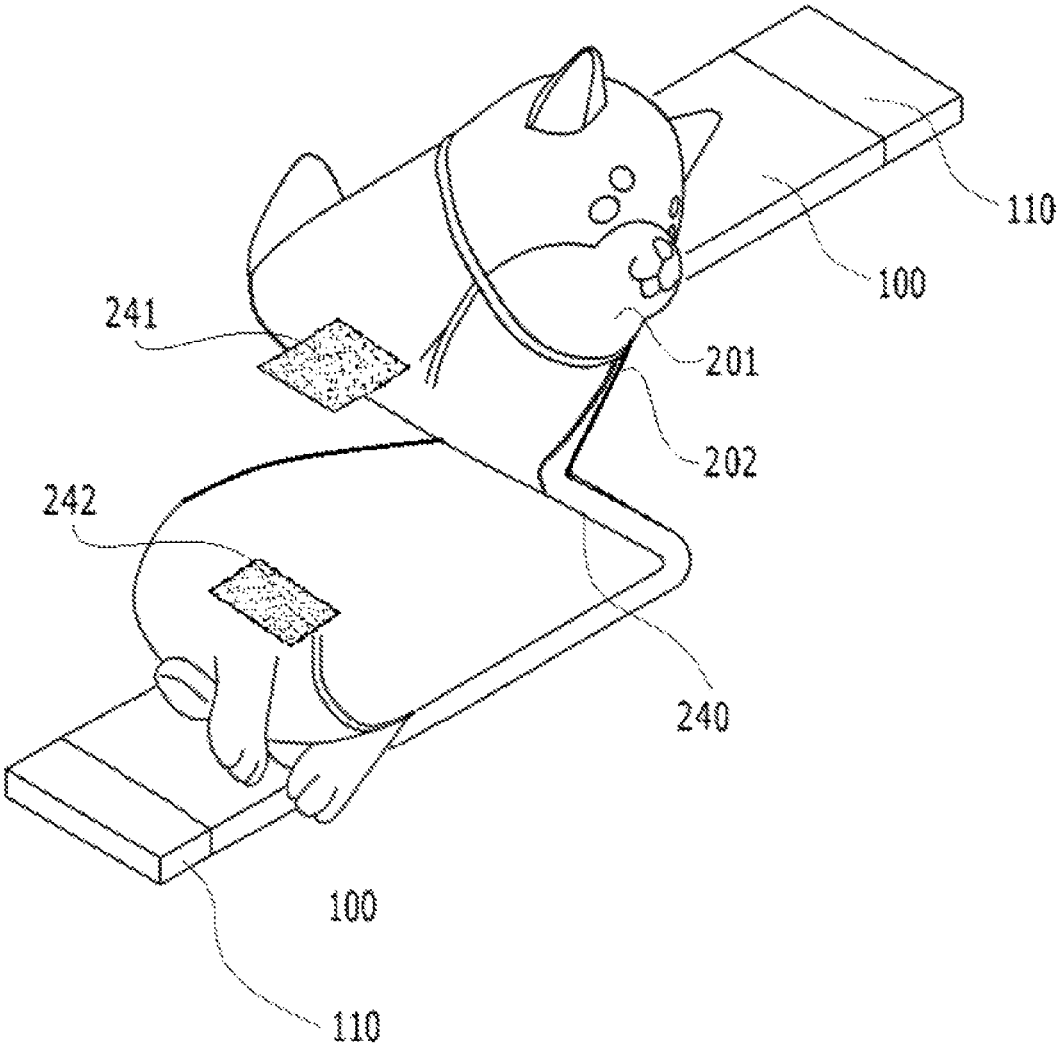
FIG. 9 shows an example of the character decoration which is adjustable in length according to one embodiment of the present disclosure.

In addition, as shown in FIG. 9, the character part 200 may further include a character folding part 240.

Accordingly, the character folding part 240 may serve to fold and unfold the character part 200, and may include character folding fastening parts 241 and 242 to be fastened when the character part 200 is folded.

The character folding part 240 is a part of the character part 200 fastened to the mobile phone handle. When the strap 100 is used as a mobile phone handle, the folded character part 200 has an aesthetic feeling as a character, and when using the portable bag 300, the character part 200 can be unfolded to make the entrance of the portable bag 300 larger.

Therefore, when the character folding part 240 is folded, and the opening/closing upper part 221 of the character opening/closing part 220 is closed, the upper end of the portable bag 300 is also folded to enter the character interior 230. In the state in which the opening/closing lower part 222 of the character opening/closing part 220 is closed after being put into the character interior 230 through the opening/closing lower part 222 by folding or rolling the portable bag 300, as a portable handle, the portable bag 300 functions as the character part 200 connected to the strap 100.

On the other hand, when the character folding part 240 is unfolded and the opening/closing upper part 221 of the character opening/closing part 220 is opened, the upper end of the portable bag 300 in the character interior 230 is exposed to the outside. In the state in which the opening/closing lower part 222 of the character opening/closing part 220 is opened, when the portable bag 300 stored in the character interior 230 is taken out through the opening/closing lower part 222 of the character opening/closing part 220 to be used, the entrance of the portable bag 300 is increased as the entrance is unfolded.

The character part 200 fastened to the strap 100 is used as a mobile phone handle, and the portable bag 300 is taken out from the character part 200 to be used in the state that the character part 200 fastened to or separated from the strap 100.

In addition, when the portable bag 300 is stored in the strap interior 130 or the character interior 230, the strap interior 130 or the character interior 230 may include an antibacterial component and deodorizing component to prevent the portable bag 300 from being contaminated with moisture or to prevent the portable bag 300 stored for a long period of time with foreign substances attached thereto from being contaminated.

The antibacterial and deodorizing component is not particularly limited, and it is sufficient to prevent contamination of the portable bag 300 in implementation of the present disclosure.

| Description of Reference Numerals |
|---|
| 1: back surface of mobile phone |
| 100: strap |
| 101: upper strap |
| 102: lower strap |
| 110: mobile phone fastening part |
| 120: strap opening/closing part |
| 121: opening/closing upper part |
| 122: opening/closing lower part |

-continued

| Description of Reference Numerals |
|---|
| 130: strap interior |
| 131: bag coupling part |
| 140: strap folding part |
| 141, 142: strap folding fastening parts |
| 150: strap back surface |
| 160: support |
| 161: support fixing part |
| 162: supporting part |
| 200: character part |
| 201: upper character |
| 202: lower character |
| 210: strap fastening part |
| 220: character opening/closing part |
| 221: opening/closing upper part |
| 222: opening/closing lower part |
| 230: character interior |
| 231: bag coupling part |
| 240: character folding part |
| 241, 242: character folding fastening parts |
| 300: portable bag |
| 310: inner coupling part |
| 320: bag handle |

I claim:

1. A strap assembly for use with a mobile phone, the strap assembly comprising:

a mobile phone fastening part adapted to be fastened to a back surface of the mobile phone, said mobile phone fastening part having one surface adapted to be positioned against the mobile phone and an opposite surface;

an opening and closing part having an upper strap and a lower strap, the lower strap being affixed against the opposite surface of said mobile phone fastening part, the upper strap having ends that are affixed to the lower strap, the upper strap having a central portion that is separable from the lower strap such that said opening and closing part has an open configuration and a closed configuration, the open configuration exposing a surface of the lower strap opposite said mobile phone fastening part, the open configuration allowing the opening and closing part to act as a handle for the mobile phone;

a portable bag removably affixed in a space between the upper strap and the lower strap; and a bag coupling part affixed to the surface of the lower strap, said portable bag being releasably secured to said bag coupling part, said portable bag having an inner coupling part and a handle, the inner coupling part of said portable bag being releasably secured to said bag coupling part, the upper strap of said mobile phone fastening part being foldable upon itself so as to have a folded configuration and an unfolded configuration, the upper strap having a fastener thereon so as to releasably fix the upper strap in the folded configuration, wherein said mobile phone fastening part has a support on a back surface thereof, the support having a support fixing part and a supporting part, the supporting part having a thin rod shape, the supporting part having one end hinge-coupled in rotatable relationship to the support fixing part.

* * * * *